US009418813B2

(12) United States Patent
Sato et al.

(10) Patent No.: US 9,418,813 B2
(45) Date of Patent: Aug. 16, 2016

(54) FUSE ASSEMBLY

(71) Applicant: ANDEN CO., LTD., Anjo, Aichi-pref. (JP)

(72) Inventors: Koichi Sato, Anjo (JP); Hirohisa Suzuki, Nishio (JP)

(73) Assignee: ANDEN CO., LTD., Anjo (JP)

( * ) Notice: Subject to any disclaimer, the term of this patent is extended or adjusted under 35 U.S.C. 154(b) by 137 days.

(21) Appl. No.: 14/036,303

(22) Filed: Sep. 25, 2013

(65) Prior Publication Data

US 2014/0148068 A1 May 29, 2014

(30) Foreign Application Priority Data

Nov. 26, 2012 (JP) ..... 2012-257764

(51) Int. Cl.
*H01H 85/20* (2006.01)
*H01H 85/041* (2006.01)

(52) U.S. Cl.
CPC ..... *H01H 85/2035* (2013.01); *H01H 85/0417* (2013.01); *H01H 2085/207* (2013.01); *H01H 2085/208* (2013.01); *H01H 2085/209* (2013.01); *H01H 2085/2075* (2013.01); *H01H 2085/2085* (2013.01)

(58) Field of Classification Search
CPC ..... H01H 85/2035; H01H 85/0417; H01H 85/24; H01H 2085/2065; H01H 2085/207; H01H 2085/208; H01H 2085/209; H01H 2085/2075; H01H 2085/2085
USPC ..... 337/230, 257, 269
See application file for complete search history.

(56) References Cited

U.S. PATENT DOCUMENTS

| | | | | |
|---|---|---|---|---|
| 5,171,293 | A * | 12/1992 | Umemoto | H01H 85/547 337/194 |
| 6,280,253 | B1 * | 8/2001 | Kraus | H01R 9/2458 439/594 |
| 6,585,541 | B2 * | 7/2003 | Higashida et al. | 439/620.27 |
| 6,781,503 | B1 * | 8/2004 | Kubota | 337/230 |
| 2002/0115349 | A1 * | 8/2002 | Fukumori | H01H 85/2035 439/620.27 |
| 2004/0155749 | A1 * | 8/2004 | Fujii | 337/187 |
| 2005/0272314 | A1 | 12/2005 | Kobayashi | |
| 2006/0087310 | A1 * | 4/2006 | Suzuki | 324/158.1 |
| 2006/0119463 | A1 * | 6/2006 | Kubota | 337/182 |
| 2008/0061920 | A1 * | 3/2008 | Kubota | H01H 85/2035 337/198 |

OTHER PUBLICATIONS

Office Action dated Nov. 4, 2015 issued in corresponding CN patent application No. 20130606655.9 (and English translation).

* cited by examiner

*Primary Examiner* — Jayprakash N Gandhi
*Assistant Examiner* — Jacob Crum
(74) *Attorney, Agent, or Firm* — Posz Law Group, PLC

(57) ABSTRACT

A first and a second pair of projecting portions are provided in a cavity portion of a fuse mounting portion made of resin. An upper end surface of each projecting portion is tapered, so as to guide a pair of male terminals of a fuse sub-assembly toward a corresponding female terminals attached to the cavity portion, when the fuse sub-assembly is inserted into the cavity portion. A gap is formed between the fuse sub-assembly and the tapered upper end surfaces in a fuse-mounted condition, in which the fuse sub-assembly is in contact with a stopper portion of the cavity portion, in order to prevent contact failure caused by thermal shock.

12 Claims, 12 Drawing Sheets

FUSE ASSEMBLY

CROSS REFERENCE TO RELATED APPLICATION

This application is based on Japanese Patent Application No. 2012-257764 filed on Nov. 26, 2012, the disclosure of which is incorporated herein by reference.

FIELD OF TECHNOLOGY

The present disclosure relates to a fuse assembly and more particularly to a structure for a fuse mounting portion of an electric connector box to which a fuse sub-assembly is mounted.

BACKGROUND

A fuse assembly is known in the art, for example, as disclosed in Japanese Patent No. 4,238,783, which discloses a structure for a fuse mounting portion of an electric connector box, to which fuse sub-assemblies are mounted. According to the structure for the fuse mounting portion of the above prior art, it is possible to mount two kinds of fuse sub-assemblies to the electric connector box, wherein outer dimensions of the fuse sub-assemblies in a fuse-insertion direction (more exactly, a length in a height direction of the fuse sub-assembly) are different from each other. A pair of ribs is provided in a cavity of a housing for the electric connector box in a width direction of the cavity, wherein each of the ribs is projecting into an inside of the cavity. An upper end surface of each rib, namely an end surface of the rib on a side to an opening end of the cavity, is inclined with respect to the fuse-insertion direction.

When the fuse sub-assembly is inserted into the cavity, a stepped portion of the fuse sub-assembly is brought into contact with the inclined surfaces of the ribs, so that the fuse sub-assembly is positioned in the fuse mounting portion.

The housing of the electric connector box of the above prior art is generally made of resin. When thermal shock is applied to the housing made of resin, the fuse mounting portion is thermally expanded or contracted. Then, a relative positional relationship between the ribs and female terminals (made of, for example, copper alloy) provided in the cavity may be changed. For example, when the cavity is thermally expanded, the fuse sub-assembly is pushed in the width direction of the cavity (perpendicular to the fuse-insertion direction) by the inclined surface of the rib.

As a result, the fuse sub-assembly is relatively moved in the cavity whenever the thermal expansion and contraction are repeated in the cavity. In other words, sliding movement of a male terminal with respect to the female terminal is repeatedly carried out in the cavity. As a result, contact failure is likely to occur between the male terminal and female terminal provided in the cavity due to abrasion powder of the terminals and/or decrease of contact pressure between the terminals. When the contact failure occurs in the fuse sub-assembly, voltage drop may occur at the terminals of the contact failure and operation of an electric or electronic devices connected to the fuse sub-assembly may be adversely affected due to such voltage drop.

SUMMARY OF THE DISCLOSURE

The present disclosure is made in view of the above problem. It is an object of the present disclosure to provide a structure of a fuse mounting portion made of resin, according to which contact failure of a fuse sub-assembly to be caused by thermal expansion and contraction can be avoided.

According to a feature of the present disclosure, a fuse sub-assembly having a pair of male terminals is inserted into a fuse mounting portion in a fuse-insertion direction. The fuse mounting portion has a cavity portion made of resin and has an opening end, through which the fuse sub-assembly is mounted to the cavity portion. The fuse mounting portion has a pair of female terminals, which is electrically connected to the respective male terminals when the fuse sub-assembly is inserted into the cavity portion. The female terminals hold the fuse sub-assembly in the cavity portion.

The cavity portion has a stopper portion, with which the fuse sub-assembly is brought into contact in a fuse-mounted condition. The cavity portion further has a pair of projecting portions projecting into an inside of the cavity portion. The projecting portions are arranged in a width direction of the cavity portion.

Guide surfaces are formed at each projecting portion for guiding the male terminals toward the female terminals when the fuse sub-assembly is inserted into the cavity portion. A distance between the pair of the guide surfaces in the width direction becomes larger in the fuse-insertion direction toward the opening end of the cavity portion.

A gap is formed between the fuse sub-assembly and the guide surfaces in the fuse-mounted condition, in which the fuse sub-assembly is inserted into the cavity portion until the fuse sub-assembly is brought into contact with the stopper portion.

According to the above structure, the fuse sub-assembly mounted to the fuse mounting portion hardly moves in the cavity portion, even when the cavity portion is thermally expanded and contracted due to thermal shock. As a result, it is possible to prevent contact failure of the fuse sub-assembly.

According to another feature of the present disclosure, multiple fuse mounting portions are integrally formed in a housing of the fuse assembly and arranged with one another in the width direction, in which the projecting portions of each pair are respectively arranged in a line.

When the multiple fuse mounting portions are arranged in the line, an outside dimension of the housing made of resin becomes larger in the width direction of the cavity portion. As a result, an amount of the thermal expansion and the thermal contraction caused by the thermal shock in the cavity portion becomes correspondingly larger in the width direction. Then, the guide surfaces formed at the projecting portions are more likely to move in the width direction, in which the fuse sub-assembly may be moved. Accordingly, the effect of the present disclosure for preventing the contact failure caused by the thermal expansion and contraction can be more remarkably produced in such fuse assembly having the multiple fuse mounting portions.

According to a further feature of the present disclosure, the gap is made to be larger in the fuse mounting portion, which is more separated from an intermediate fuse mounting portion in the width direction.

According to such a structure, the gap between the fuse sub-assembly and the guide surfaces can be designed by a proper value so as to prevent the contact failure of the fuse sub-assembly, which may be caused by thermal expansion and/or thermal contraction of the cavity portion 16. In addition, since it is not necessary to make the gap larger than needs at a center of the housing or at the intermediate fuse mounting portion, it is possible to make an outside dimension of the housing at a proper value. For example, when compared with a case in which the gap is made equal to one another among the fuse mounting portions, the outside dimension of the housing can be made smaller in the above structure.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

The present disclosure will be explained hereinafter byway of an embodiment with reference to the drawings.

Figure 1A:
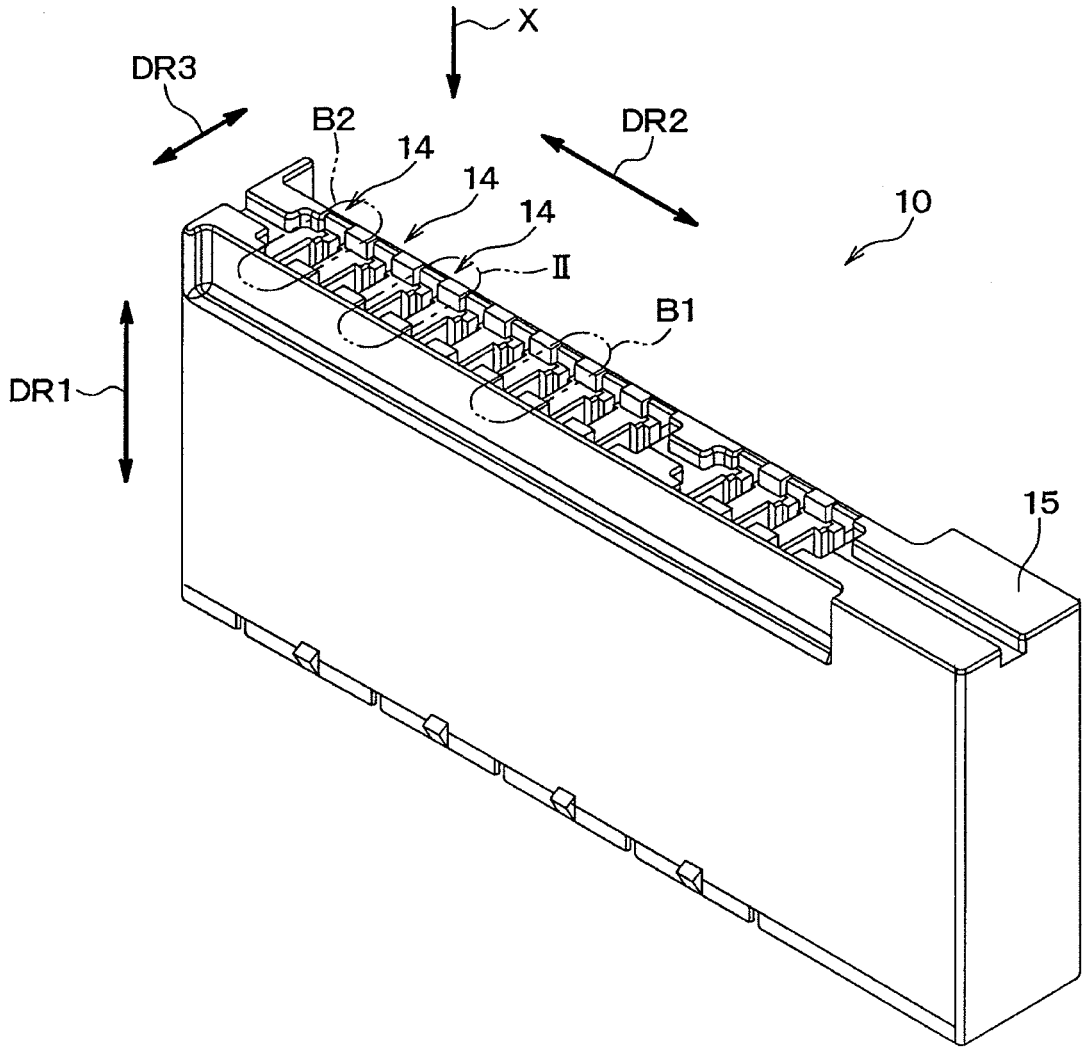
FIG. 1A is a schematic perspective view showing an electric connector box according to an embodiment of the present disclosure.

As shown in FIG. 1A, an electric connector box 10 has multiple fuse mounting portions 14, to each of which a fuse sub-assembly 12 (shown in FIGS. 6 and 7A to 7D) is mounted. The electric connector box 10 is, for example, a fuse box for a vehicle, or a relay box having the multiple fuse mounting portions 14 and electrical parts and/or components, such as, relays. The electric connector box 10 is mounted, for example, in an engine room of the vehicle. A housing 15, which forms a part of a casing of the electric connector box 10, is made of resin, for example, PBT resin, PP resin or the like.

A structure of the fuse mounting portion 14 of the electric connector box 10 will be explained. Although the electric connector box 10 has multiple fuse mounting portions 14 arranged in a line, each of the fuse mounting portions 14 has the same structure to one another. In FIG. 1A (as well as in the other drawings), an arrow X is a fuse-insertion direction in which the fuse sub-assembly 12 is inserted into the corresponding fuse mounting portion 14. An arrow DR1 is referred to as a first direction or a height direction of the fuse sub-assembly 12, which is parallel to the fuse-insertion direction X. An arrow DR2 is referred to as a second direction, in which the multiple fuse mounting portions 14 are arranged in a row. The second direction DR2 corresponds to a thickness direction or a width direction of the fuse sub-assembly 12. An arrow DR3 is referred to as a third direction or a longitudinal direction of the fuse sub-assembly 12, which is perpendicular to the first and second directions DR1 and DR2. The second direction DR2 is perpendicular to the first direction DR1.

Figure 2:
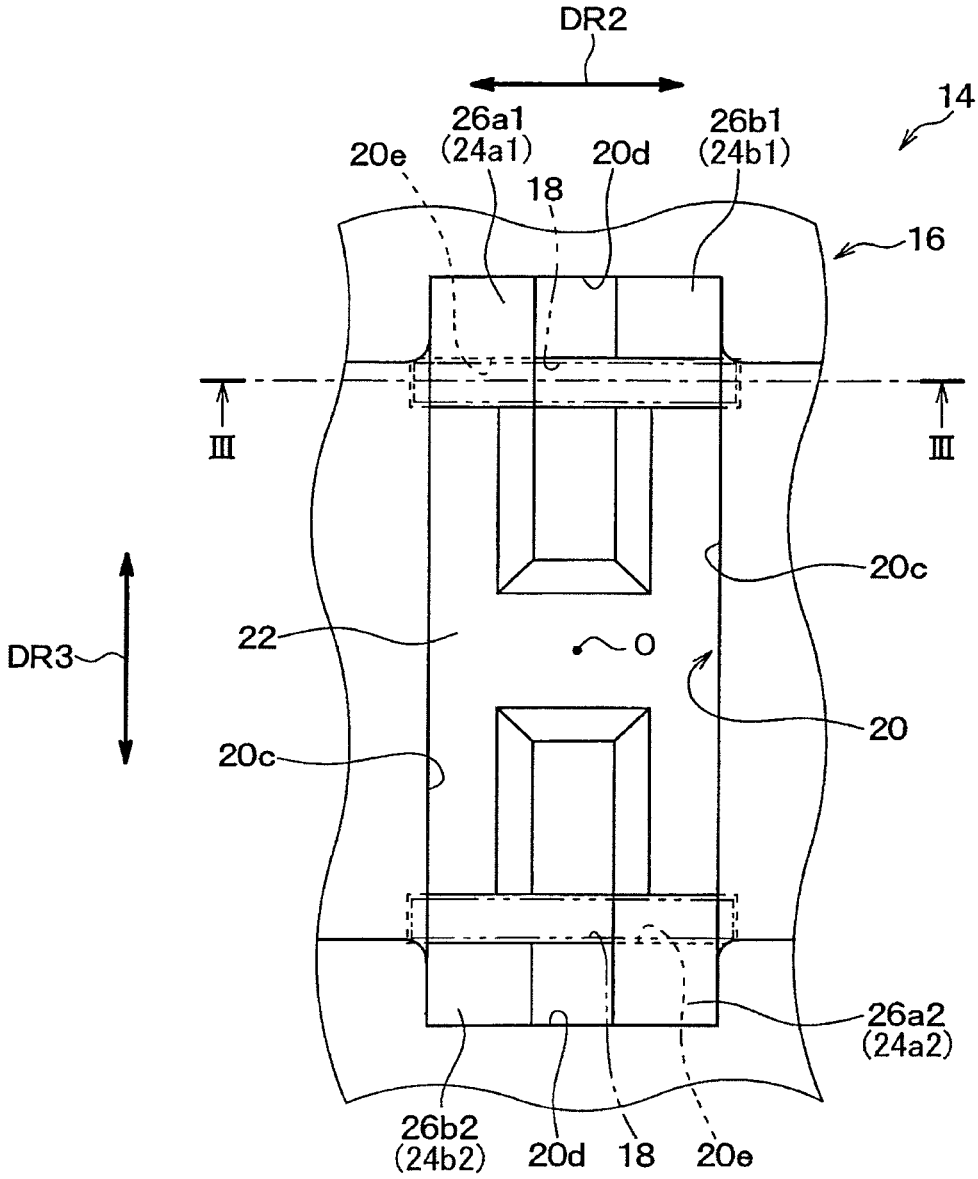
FIG. 2 is a schematic enlarged view of the fuse mounting portion indicated by II in FIG. 1A, when viewed in a fuse-insertion direction X.

The fuse mounting portion 14 is symmetrical with respect to a center point "O" in FIG. 2. Therefore, a structure of an upper-side portion of the fuse mounting portion 14 in FIG. 2 is identical to that of a lower-side portion thereof in FIG. 2.

As shown in FIG. 1B and FIGS. 2 to 4, each of the fuse mounting portions 14 is composed of a cavity portion 16 and a pair of female terminals 18, which is indicated by two-dot-chain lines. The cavity portion 16 is formed in a part of the housing 15. A fuse accommodating hole 20 is formed in the cavity portion 16. One end of the fuse accommodating hole 20 (an upper end thereof in FIGS. 3 and 4) is an opening end 20*b*, while the other end of the fuse accommodating hole 20 (that is, a lower end thereof in FIG. 4) is closed by a bottom wall 20*a*. A cross-sectional shape of the fuse accommodating hole 20 on a plane perpendicular to the fuse-insertion direction X, that is, a plane perpendicular to the first direction DR1 is almost a rectangular (as seen from FIG. 2). The bottom wall 20*a* of the fuse accommodating hole 20, namely, the bottom wall 20*a* of the cavity portion 16 extends in the longitudinal direction of the fuse sub-assembly 12, which corresponds to the third direction DR3. The fuse sub-assembly 12 is inserted into the fuse accommodating hole 20 from the upper end (the opening end 20*b*) of the fuse accommodating hole 20 (that is, the upper end 20*b* of the cavity portion 16).

A pair of through-holes 20*e* is formed in the bottom wall 20*a* of the fuse accommodating hole 20. Each of the female terminals 18 is inserted from the outside of the cavity portion 16 into the cavity portion 16 through the corresponding through-hole 20*e*. Each of the through-holes 20*e* is formed at an almost longitudinal end of the bottom wall 20*a* in the third direction DR3 (as seen from FIG. 2 or 4).

Figure 1B:
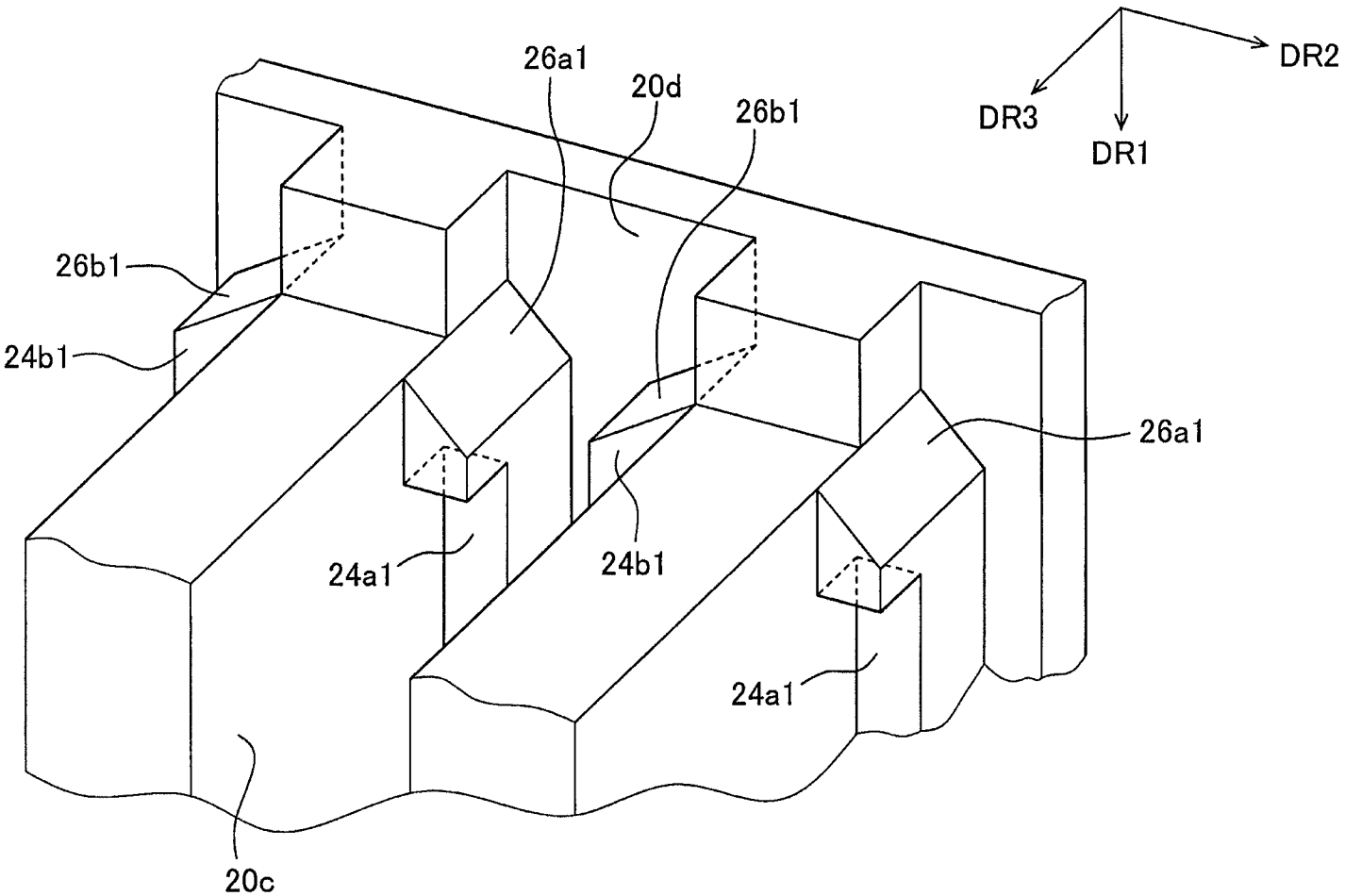
FIG. 1B is a schematically enlarged perspective view showing a part of fuse mounting portions of the electric connector box of FIG. 1A.
Figure 3:
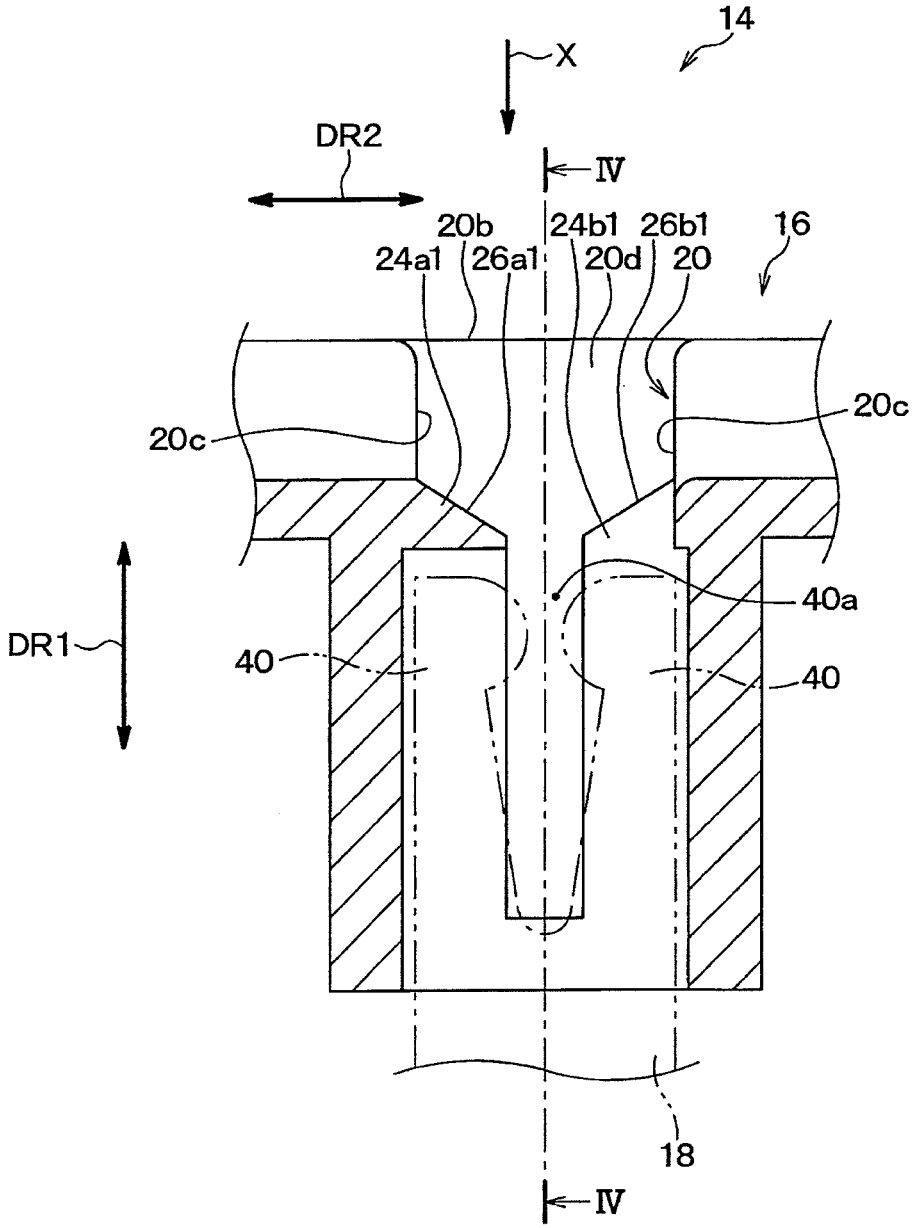
FIG. 3 is a schematic cross sectional view taken along a line III-III in FIG. 2.
Figure 4:
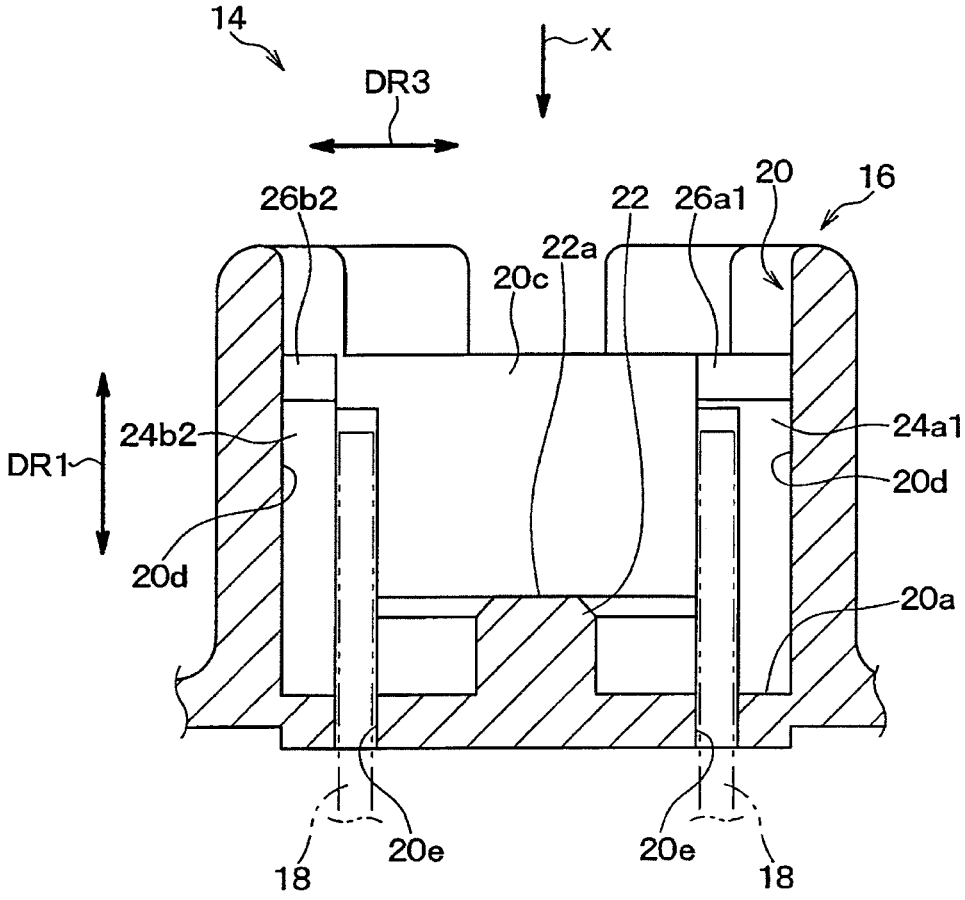
FIG. 4 is a schematic cross sectional view taken along a line IV-IV in FIG. 3.

In the cavity portion 16, a stopper portion 22 is formed in the bottom wall 20*a* (FIG. 4). In addition, as shown in FIG. 1B and FIG. 3, a first pair of projecting portions 24*a*1 and 24*b*1 is formed in the cavity portion 16 (in the upper-side portion in FIG. 2), wherein each of the projecting portions 24*a*1 and 24*b*1 is formed at each corner of the rectangular-shaped fuse accommodating hole 20. The first pair of the projecting portions 24*a*1 and 24*b*1 is arranged in the second direction DR2. In a similar manner, a second pair of projecting portions 24*a*2 and 24*b*2 is formed in the cavity portion 16 (in the lower-side portion in FIG. 2). Each of the projecting portions 24*a*2 and 24*b*2 is formed at each of the other corners of the fuse accommodating hole 20 and arranged in the second direction DR2.

The projecting portions 24*a*1 and 24*b*1 as well as 24*a*2 and 24*b*2 are collectively referred to as the projecting portions 24.

The stopper portion 22 as well as the projecting portions 24 form a part of the housing 15 made of the resin. The stopper portion 22 is projected in the first direction DR1, that is, in a direction to the cavity portion 16 from a center of the bottom wall 20*a* of the fuse accommodating hole 20. As shown in FIG. 2, the stopper portion 22 is formed between the pair of the through-holes 20*e* formed in the bottom wall 20*a*, that is, at an intermediate position in the third direction DR3. A fuse contacting surface 22*a* is so formed on a top surface of the stopper portion 22 as to be perpendicular to the first direction DR1.

The fuse contacting surface 22*a* is brought into contact with the fuse sub-assembly 12 in the first direction DR1, when the fuse sub-assembly 12 is inserted into the fuse accommodating hole 20, namely when the fuse sub-assembly 12 is mounted to the fuse mounting portion 14. In other words, the fuse contacting surface 22*a* is in contact with the fuse sub-assembly 12 in a fuse-mounted condition.

Each of the projecting portions 24 (24*a*1, 24*b*1, 24*a*2, 24*b*2) is projected into the cavity portion 16. Since each of the projecting portions 24 is formed at each corner of the cavity portion 16, at which side walls 20*c* and 20*d* of the fuse accommodating hole 20 intersect with each other, each of the projecting portions 24 is projected into the cavity portion 16 from the side walls 20*c* and 20*d* of the fuse accommodating hole 20. The first pair of the projecting portions 24 (24*a*1 and 24*b*1) is formed at a longitudinal end of the fuse accommodating hole 20 in the third direction DR3 (in the upper-side portion in FIG. 2), while the second pair of the projecting portions 24 (24*a*2 and 24*b*2) is formed at the other longitudinal end of the fuse accommodating hole 20 in the third direction DR3 (in the lower-side portion in FIG. 2). As above, two pairs of the projecting portions 24 are formed in the cavity portion 16 so as to oppose to each other in the third direction DR3.

Figure 8A:
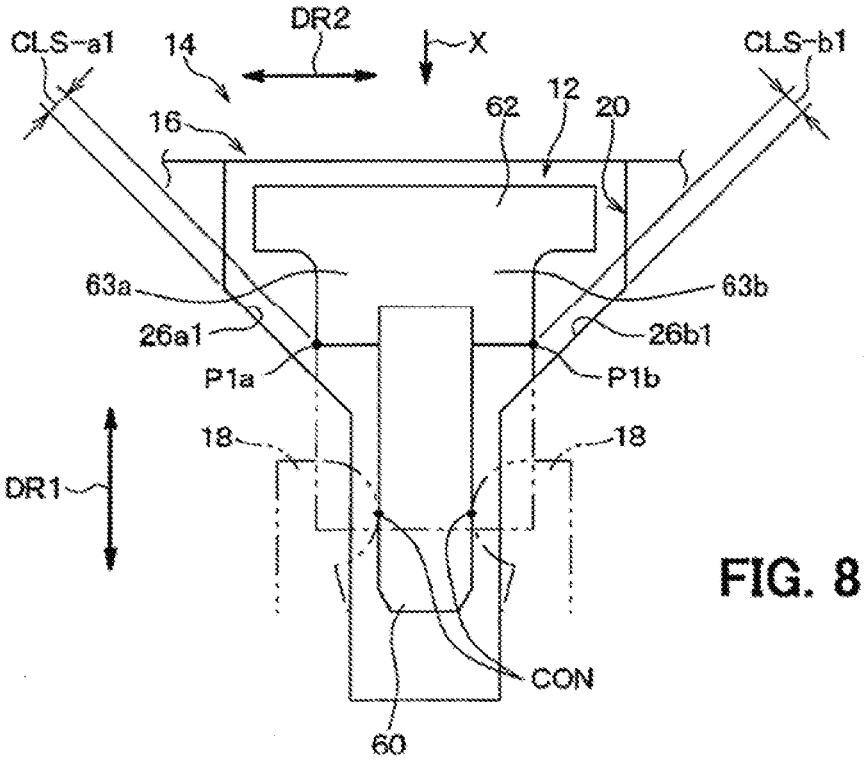
FIG. 8A is a schematic view showing the fuse sub-assembly of FIG. 6, which is mounted to the fuse mounting portion of FIG. 3.

The projecting portions 24 (24*a*1 and 24*b*1, or 24*a*2 and 24*b*2) of each pair are arranged in a thickness direction of a male terminal 60 (FIGS. 6 and 7A to 7D), that is, in the second direction DR2, so as to sandwich the male terminal 60 in the fuse-mounted condition, as shown in FIG. 8A.

Guide surfaces 26*a*1, 26*b*1, 26*a*2 and 26*b*2 are formed at each projecting portion 24 (24*a*1, 24*b*1, 24*a*2 and 24*b*2) in order to smoothly guide the male terminals 60 of the fuse sub-assembly 12 into the fuse accommodating hole 20 (namely, into the cavity portion 16), so that each of the male terminals 60 is inserted into the respective female terminals 18 when the fuse sub-assembly 12 is mounted to the fuse mounting portion 14. The guide surfaces 26*a*1, 26*b*1, 26*a*2 and 26*b*2 are collectively referred to guide surfaces 26. More in detail, each of the guide surfaces 26 is formed at an upper end surface of each projecting portion 24, wherein the upper end surface is a surface of the projecting portion 24 on a side closer to the opening end 20*b* of the fuse accommodating hole 20 in the first direction DR1. As shown in FIGS. 3 and 4, each of the guide surfaces 26 (26*a*1 and 26*b*1) is formed at a position between the opening end 20*b* of the fuse accommodating hole 20 and the female terminals 18 in the first direction DR1.

Each of the guide surfaces 26*a*1 and 26*b*1 is tapered in the first direction DR1. More in detail, each of the guide surfaces 26*a*1 and 26*b*1 is formed with an inclined surface (a tapered surface), which extends in parallel to the third direction DR3 and is inclined with respect to the first direction DR1, so that the male terminals 60 of the fuse sub-assembly 12 can be smoothly guided to the female terminals 18. As shown in FIG. 1B or FIG. 3, the guide surfaces 26*a*1 and 26*b*1 of the first pair of the projecting portions 24*a*1 and 24*b*1 are opposing to each other in the second direction DR2. A distance between the opposing guide surfaces 26*a*1 and 26*b*1 in the second direction DR2 becomes larger in the first direction DR1 toward the opening end 20*b* of the fuse accommodating hole 20. Each of the guide surfaces 26*a*2 and 26*b*2 of the second pair is likewise tapered in the first direction DR1 in the same manner to the guide surfaces 26*a*1 and 26*b*1 of the first pair of the projecting portions 24*a*1 and 24*b*1.

As shown in FIG. 1B and FIGS. 2 and 3, a length of the guide surface 26*a*1 in the third direction DR3 (in the longitudinal direction) is made to be larger than that of the guide surface 26*b*1. In other words, a part the guide surface 26*a*1 extends in the third direction DR3 to form a roof-like portion. The roof-like portion of the guide surface 26*a*1 overlaps with the female terminal 18 in the first direction DR1 (in the height direction), while the guide surface 26*b*1 has no such a portion overlapping the female terminal 18 in the height direction DR1.

Figure 5:
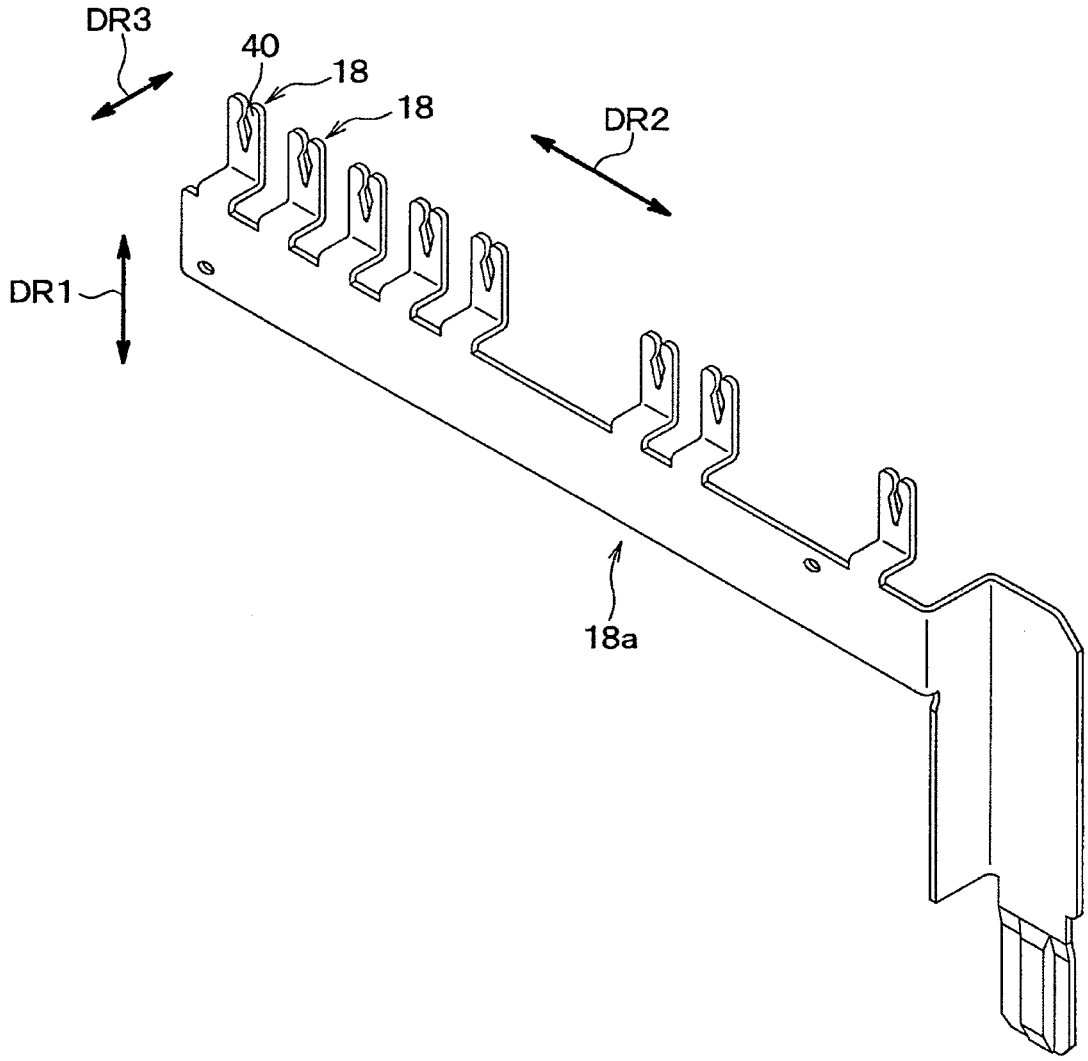
FIG. 5 is a schematic perspective view showing a terminal member, in which multiple female terminals are formed.

As shown in FIGS. 3 and 5, each of the female terminals 18 is formed in a tuning-fork shape having a pair of forked ends 40 and a press-insert gap 40*a* between the forked ends 40. When the fuse sub-assembly 12 is inserted into the fuse accommodating hole 20, a forward end of the male terminal 60 of the fuse sub-assembly 12 is brought into contact with the guide surfaces 26. Then, each of the forward ends of the male terminals 60 is guided along the guide surfaces 26 as the fuse sub-assembly 12 is inserted in the fuse insertion direction X (the first direction DR1), so that each of the forward ends is moved toward the press-insert gap 40*a* of each female terminal 18.

The female terminal 18 is made of copper alloy, which is generally used as material for terminals. As shown in FIG. 4, the female terminals 18 of one pair are arranged in the third direction DR3. Each of the forked ends 40 forms a press-insert terminal portion 40 opposing to each other in the second direction DR2. Each of the female terminals 18 is inserted through the through-hole 20*e* and fixed to the housing 15. For example, one of the female terminals 18 of each pair in the fuse mounting portion 14 is insert-molded with the housing 15. The other female terminal 18 of the pair in the fuse mounting portion 14 is integrally formed with the terminal member forming a bus bar 18*a* (FIG. 5) but as an independent component from the housing 15. Then, the female terminals 18 of the bus bar 18*a* are attached to the housing 15.

As shown in FIGS. 3 and 4, the press-insert terminal portions 40 of the female terminal 18 are projected in the first direction DR1 into the fuse accommodating hole 20 from the bottom wall 20*a* toward the opening end 20*b*. As already explained above, each of the female terminals 18 is inserted through the through-hole 20*e* formed in the bottom wall 20*a* and protruded into the fuse accommodating hole 20, so that the press-insert gap 40*a* of the female terminal 18 is arranged in the fuse accommodating hole 20 and directed toward the opening end 20*b*.

When the male terminal 60 of the fuse sub-assembly 12 is inserted into the press-insert gap 40*a* of the female terminal 18 in the fuse insertion direction X, the male terminal 60 and the female terminal 18 are electrically connected to each other. At the same time, the female terminal 18 physically holds the male terminal 60 inserted into the press-insert gap 40*a*. In other words, the pair of the female terminals 18 holds the fuse sub-assembly 12 in the fuse accommodating hole 20 (that is, in the cavity portion 16).

As shown in FIG. 5, one of the female terminals 18 of each female-terminal pair is connected to another one of the female terminals 18 of the other female-terminal pair of the neighboring fuse mounting portion 14, so that each one of the respective pairs of the female terminals 18 provided in each fuse mounting portion 14 is aligned in a straight line in the second direction DR2. In other words, each one of the female terminals 18 of the respective female-terminal pairs provided in the respective fuse mounting portions 14 is connected to the common terminal member, to form the bus bar 18*a* extending in the second direction DR2.

The fuse sub-assembly 12 will be explained with reference to FIGS. 6 and 7A to 7D. The fuse sub-assembly 12 is a blade-type fuse, which is generally used for the vehicle. The fuse sub-assembly 12 has a pair of the male terminals 60 and a fuse main body 62 integrally connected to the male terminals 60.

Each of the male terminals 60 is made of metal and formed in a plate shape. In the fuse-mounted condition, a thickness direction of the male terminals 60 corresponds to the second direction DR2 and the male terminals 60 of each male-terminal pair are aligned in the third direction DR3 (in the longitudinal direction of the fuse sub-assembly 12).

Figure 6:
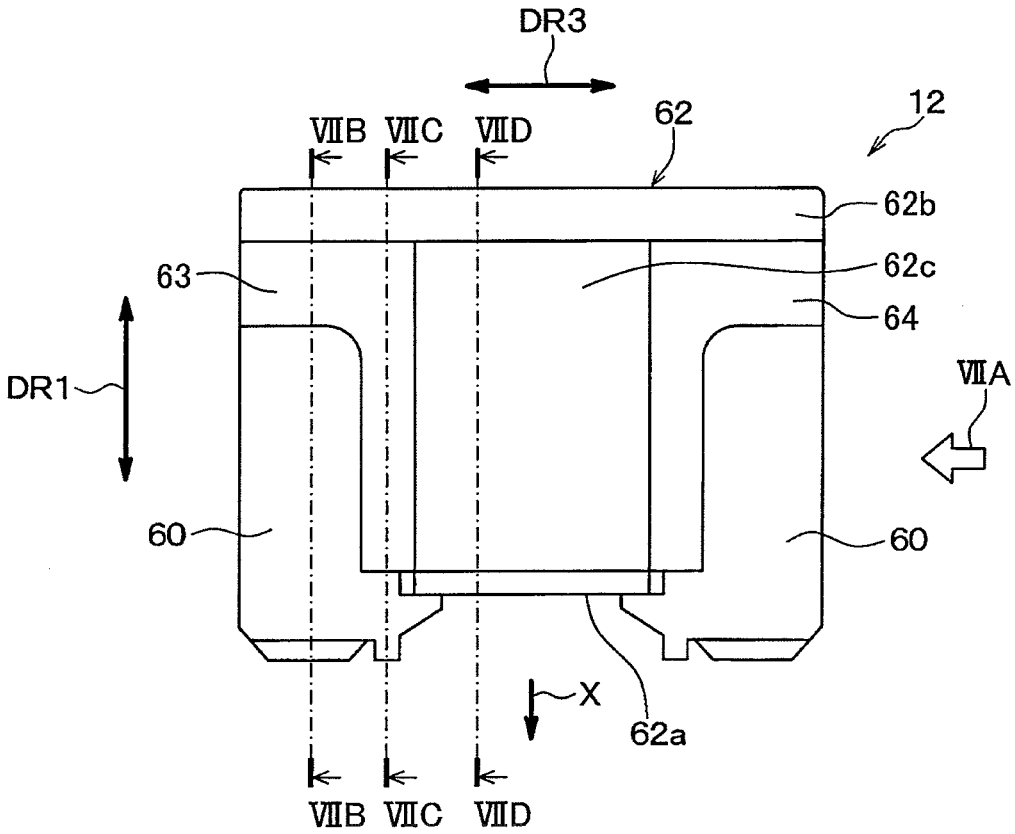
FIG. 6 is a schematic front view showing a fuse sub-assembly, which is mounted to the fuse mounting portion of FIG. 1A.
Figure 7A:
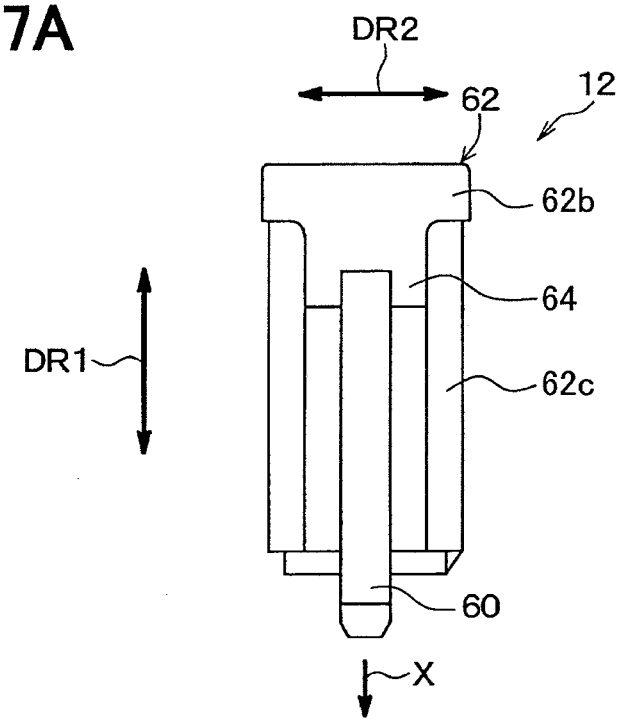
FIG. 7A is a schematic side view showing the fuse sub-assembly, when viewed in a direction VIIA in FIG. 6.
Figure 7B:
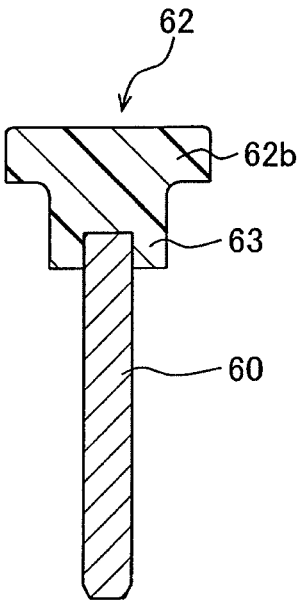
FIG. 7B is a schematic cross sectional view taken along a line VIIB-VIIB in FIG. 6.
Figure 7C:
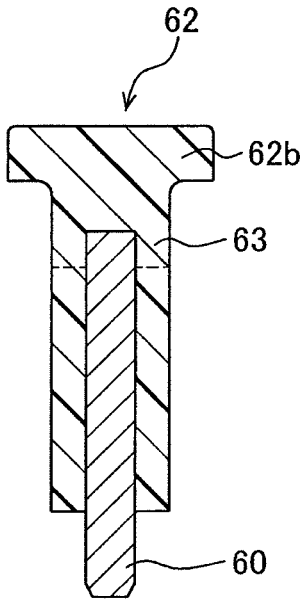
FIG. 7C is a schematic cross sectional view taken along a line VIIC-VIIC in FIG. 6.
Figure 7D:
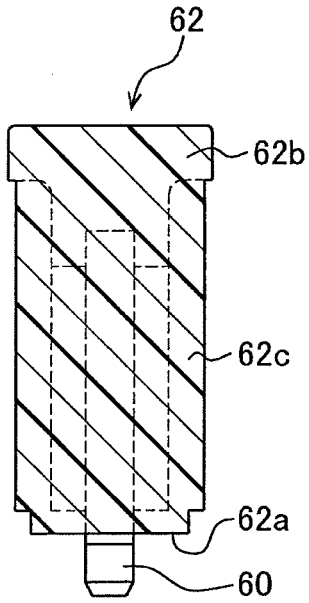
FIG. 7D is a schematic cross sectional view taken along a line VIID-VIID in FIG. 6.

The fuse main body 62 is made of resin, for example, polyamide resin. The fuse main body 62 includes inside thereof a fuse element (not shown), which is provided between the male terminals 60 of the pair and respectively connected to the male terminals 60. As shown in FIG. 6, a base body portion 62*b* of the fuse main body 62, that is an upper portion in FIG. 6, extends in the third direction DR3 along a whole length of the fuse sub-assembly 12. An intermediate portion 62*c* of the fuse main body 62 extends from the base body portion 62*b* in the fuse insertion direction X in an area between the pair of the male terminals 60 to a point close to a forward end of each male terminal 60.

A pair of shoulder portions 63 and 64 is integrally formed with the base body portion 62*b* at both longitudinal sides of the intermediate portion 62*c* in the third direction DR3. In other words, the shoulder portion 63 is formed at a longitudinal end of the base body portion 62*b* (in a left-hand side in FIG. 6), while the shoulder portion 64 is formed at another longitudinal end of the base body portion 62*b* (in a right-hand side in FIG. 6).

A thickness of the base body portion 62*b* is larger than that of the male terminals 60 in the second direction DR2. A contacting portion 62*a* is formed at a lower end of the intermediate portion 62*c*. The contacting portion 62*a* is brought into contact with the fuse contacting surface 22*a* of the stopper portion 22 in the fuse-mounted condition. The contacting portion 62*a* is formed by a flat surface perpendicular to the fuse insertion direction X (the first direction DR1).

The fuse sub-assembly 12 is inserted into the fuse accommodating hole 20 of the fuse mounting portion 14 so that the fuse sub-assembly 12 is mounted to the fuse mounting portion 14. In the fuse-mounted condition, each of the male terminals 60 is interposed between the pair of the forked ends 40 of the respective female terminals 18, so that the fuse sub-assembly 12 is firmly supported in the fuse mounting portion 14. The contacting portion 62*a* of the fuse main body 62 is in contact with the fuse contacting surface 22*a* of the stopper portion 22 in the first direction DR1, so that the fuse sub-assembly 12 is positioned in the fuse mounting portion 14 in the first direction DR1. FIG. 8A schematically shows, in a cross section of the second direction DR2, the fuse sub-assembly 12 mounted to the fuse mounting portion 14 in the fuse-mounted condition.

As shown in FIG. 8A, the fuse sub-assembly 12 is inserted into the fuse accommodating hole 20 (into the cavity portion 16) of the fuse mounting portion 14 until the fuse sub-assembly 12 is brought into contact with the stopper portion 22. A gap is formed between the fuse sub-assembly 12 and the fuse mounting portion 14 in the first and second directions DR1 and DR2. More exactly, a first gap CLS-a is formed between a first lower edge P1*a* of a left-hand side 63*a* of the shoulder portion 63 and the guide surface 26*a*1 of the first pair. A second gap CLS-b is likewise formed between a second lower edge P1*b* of a right-hand side 63*b* of the shoulder portion 63 and the guide surface 26*b*1 of the first pair.

The first lower edge P1*a* corresponds to a most neighboring point of the fuse sub-assembly 12 to the guide surface 26*a*1, at which the first lower edge P1*a* is closest to the guide surface 26*a*1 in the fuse-mounted condition. In a similar manner, the second lower edge P1*b* corresponds to a most neighboring point of the fuse sub-assembly 12 to the guide surface 26*b*1, at which the second lower edge P1*b* is closest to the guide surface 26*b*1 in the fuse-mounted condition.

As above, even in the fuse-mounted condition, in which a part of the fuse main body 62 (the first and/or second lower edges P1*a* and/or P1*b*) is located at the position closest to the guide surface 26*a*1 and/or 26*b*1, the gaps CLS-a and CLS-b are formed between the first and second lower edges P1*a* and P1*b* and the guide surfaces 26*a*1 and 26*b*1. In other words, any part of the fuse main body 62 is not brought into contact with the guide surfaces 26*a*1 and 26*b*1, when the fuse sub-assembly 12 is inserted into the fuse accommodating hole 20.

The first gap CLS-a and the second gap CLS-b are collectively referred to as the gap(s) CLS. A value of the gap CLS is determined based on a positional relationship between the fuse contacting surface 22*a* of the stopper portion 22 and the guide surfaces 26*a*1 and 26*b*1 as well as a positional relationship between the contacting portion 62*a* of the fuse main body 62 and the most neighboring points P1*a* and P1*b* of the fuse sub-assembly 12 to the guide surfaces 26*a*1 and 26*b*1 in the fuse-mounted condition. Since the contacting portion 62*a* is in contact with the fuse contacting surface 22*a* in the fuse-mounted condition, the fuse sub-assembly 12 is not allowed to further move in the fuse insertion direction X from the position shown in FIG. 8A.

Each of the gaps CLS-a and CLS-b, shown in FIG. 8A, formed between the fuse sub-assembly 12 and the respective guide surfaces 26*a*1 and 26*b*1 may be identical to, or different from, each other.

Figure 9:
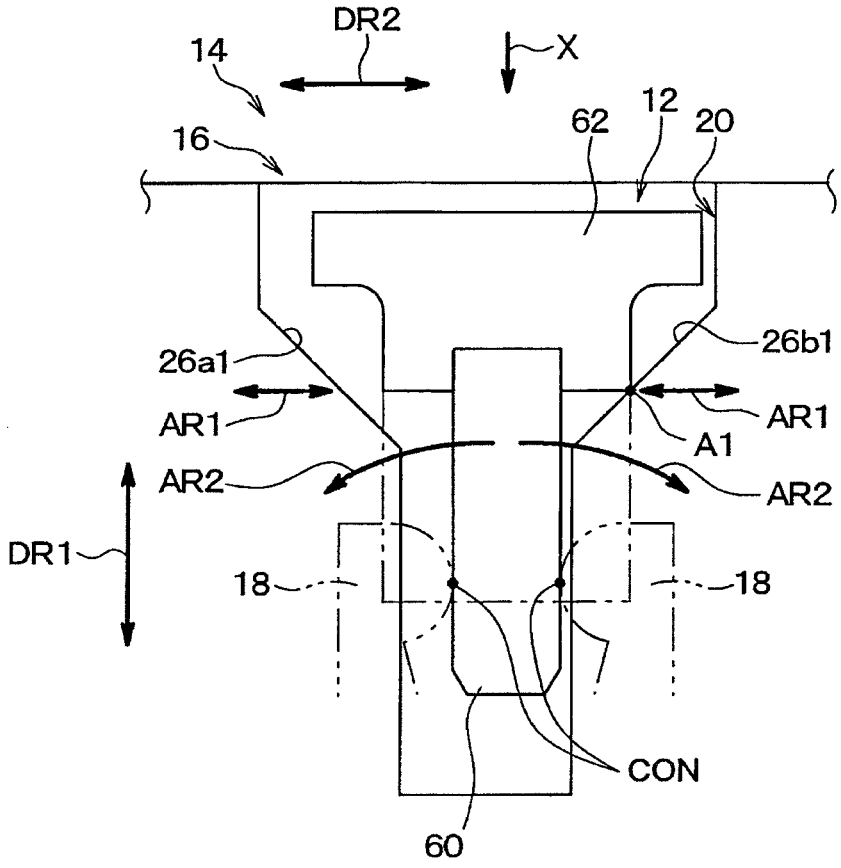
FIG. 9 is a schematic view showing the fuse sub-assembly, a fuse main body of which is brought into contact with a guide surface of the fuse mounting portion.

If the fuse main body 62 is in contact with the guide surface 26*b*1 at a contacting point Al, as shown in FIG. 9, the fuse sub-assembly 12 may swing in the second direction DR2 as indicated by an arrow AR2 when the cavity portion 16 thermally expands or contracts in a direction of an arrow AR1. The swinging movement of the fuse sub-assembly 12 continues, so long as the cavity portion 16 repeatedly and thermally expands and contracts. Then, the male terminal 60 repeatedly slides on the female terminal 18 at terminal contacting points CON.

According to the present embodiment, however, as shown in FIG. 8A, the gap CLS is formed between the fuse sub-assembly 12 and the guide surfaces 26 (26*a*1, 26*b*1, 26*a*2, 26*b*2) formed in the cavity portion 16 in the fuse-mounted condition, in which the fuse sub-assembly 12 is inserted into the fuse accommodating hole 20 until the fuse sub-assembly 12 is brought into contact with the stopper portion 22. Therefore, the fuse sub-assembly 12 is prevented from swinging due to the thermal expansion and/or thermal contraction of the cavity portion 16 caused by thermal impulses. As a result, it is possible to avoid contact failure of the fuse sub-assembly 12, namely the contact failure between the male terminals 60 and the female terminals 18.

In FIG. 9, the fuse main body 62 is in contact with the guide surface 26*b*1 but not in contact with the other guide surface 26*a*1. However, even when the fuse main body 62 is in contact with both of the guide surfaces 26*a*1 and 26*b*1, the swinging movement of the fuse sub-assembly 12 may occur in the second direction DR2 like the movement indicated by the arrow AR2. This is because an amount of displacement of the guide surfaces 26*a*1 and 26*b*1 (as well as 26*a*2 and 26*b*2) caused by the thermal fluctuation is different from an amount of displacement of the female terminal 18.

In FIG. 8A (in the fuse-mounted condition), the gap (CLS-a, CLS-b) is formed between the fuse sub-assembly 12 and all area of the guide surfaces 26*a*1 and 26*b*1. It is sufficient for the present embodiment that the gap is formed at least at a normal temperature, for example, at 20° C. A value of the gap CLS is so designed as to avoid the contact failure of the fuse sub-assembly 12 between the male and the female terminals 60 and 18, even when the electrical connector box 10 is subjected to high or low temperature in its actual environment of usage.

According to the present embodiment, multiple fuse mounting portions 14 are aligned in a straight line, in which the pairs of the projecting portions 24 (24*a*1, 24*b*1 or 24*a*2, 24*b*2) are arranged, as shown in FIG. 1A. As a result, an outer shape of the housing 15 made of the resin, in which the multiple cavity portions 16 are formed, becomes larger in the second direction DR2 in which the multiple fuse mounting portions 14 are formed.

Therefore, an amount of thermal expansion and/or thermal contraction of the cavity portions 16 may become correspondingly larger in the second direction DR2. Then, the guide surfaces 26 formed on the projecting portions 24 are likely to move in the direction, in which the fuse sub-assembly 12 is forced to swing. According to the present embodiment (having the multiple fuse mounting portions 14 in the line), the effect for preventing the contact failure of the fuse sub-assembly 12 caused by the thermal fluctuation can become more remarkable, when compared with a case having one fuse mounting portion.

In the fuse-mounted condition of the present embodiment, the contacting portion 62*a* of the fuse sub-assembly 12 is brought into contact with the fuse contacting surface 22*a* of the cavity portion 16 in order to position the fuse sub-assembly 12 in the fuse mounting portion 14 in the first direction DR1. When the cavity portion 16 as well as the fuse main body 62 is thermally expanded, the fuse sub-assembly 12 is pushed back in the opposite direction to the fuse-insertion direction X.

When the fuse sub-assembly 12 is once pushed back, the fuse sub-assembly 12 is held at such a pushed-back position. When the thermally expanded cavity portion 16 of the fuse main body 62 is turned back to its initial condition, a gap is generated in the first direction DR1 between the contacting portion 62*a* and the fuse contacting surface 22*a*. As a result, even when the cavity portion 16 and the fuse main body 62 thereafter repeat the thermal expansion and the thermal contraction, the male terminal 60 does not repeatedly slide on the female terminal 18 in the first direction DR1. The contact failure of the fuse sub-assembly 12 can be thus avoided.

OTHER EMBODIMENTS AND/OR MODIFICATIONS

The present disclosure should not be limited to the above embodiment but can be modified in various manners, for example, in the following manners.

(1) In the above embodiment, as shown in FIG. 1B and FIGS. 2 and 3, the part of the guide surface 26*a*1 (the roof-like portion) is so formed as to overlap with the female terminal 18 in the first direction DR1 (in the height direction), while the other guide surface 26*b*1 does not have such a part overlapping with the female terminal 18 in the height direction DR1. However, the other guide surface 26*b*1 can be also so modified as to overlap with the female terminal 18 in the height direction DR1.

(2) In the above embodiment, each of the guide surfaces 26*a*1, 26*b*1, 26*a*2 and 26*b*2 is formed by the flat surface. However, the guide surface(s) can be formed by a curved surface of a concave or a convex, as shown in FIGS. 8C and 8D, respectively.

(3) In the above embodiment, the fuse sub-assembly 12 is composed of so-called a low-type fuse having a small height. However, any type of fuses, such as, so-called a mini-type fuse, can be used. In the above embodiment, as shown in FIG. 8A, the entire body of the fuse sub-assembly 12 is accommodated in the cavity portion 16 in the fuse-mounted condition. However, a part of the fuse sub-assembly may not be accommodated in the cavity portion 16.

(4) In the above embodiment, each of the male terminals 60 is composed of the plate-type terminal. The male terminal 60 may not be always made of the plate-type terminal.

Figure 10:
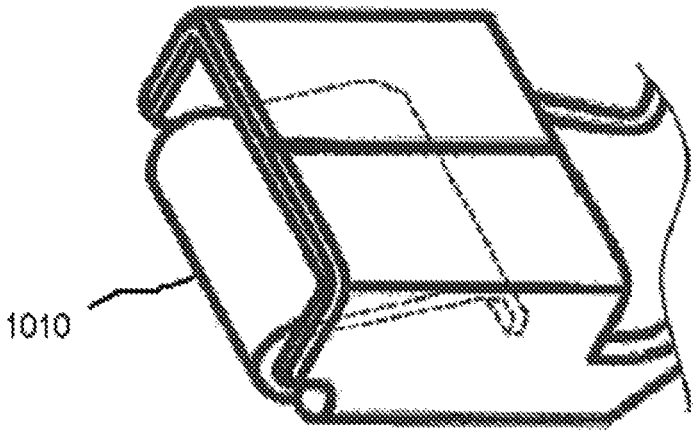
FIG. 10 is a schematic view showing a tongue-shaped female terminal.
Figure 11:
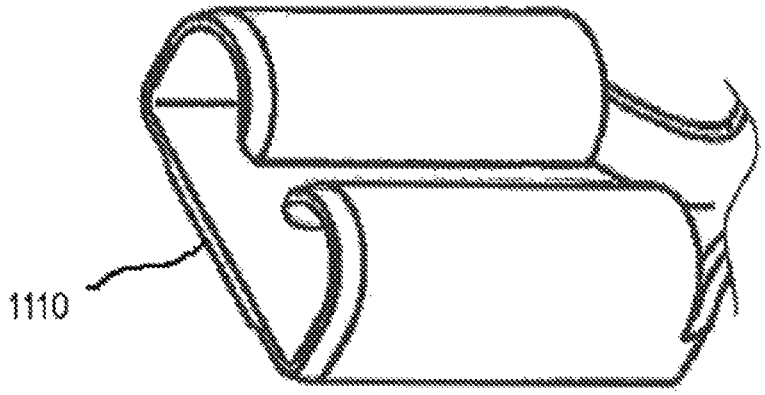
FIG. 11 is a schematic showing a faston female terminal.

(5) In the above embodiment, the female terminal 18 of the fuse mounting portion 14 is composed of the press-insert type terminal. However, the female terminal 18 may be made of any other types, such as a tongue-shaped terminal, a faston terminal, and so on. An example of a tongue-shaped female terminal is disclosed in FIG. 10, while an example of a faston female terminal is shown in FIG. 11.

(6) In the above embodiment, the guide surfaces 26 are so made that the gap CLS in one fuse mounting portion 14 is made to be identical to the gap CLS in the other fuse mounting portion 14. However, the gaps CLS may be different from the fuse mounting portion 14 to the fuse mounting portion 14.

For example, the gap CLS in each fuse mounting portion 14 can be made larger in a direction from a center of the housing 15 toward an outer side thereof in the second direction DR2 or in a direction from an intermediate fuse mounting portion 14 toward an outer-most fuse mounting portion 14 in the second direction DR2. In other words, the gap CLS defined in FIG. 8A in the fuse mounting portion 14 located at a position B2 in FIG. 1A is larger than the gap CLS in the fuse mounting portion 14 located at a position B1 (the center of the housing 15 in the second direction DR2).

According to such a modification, the gap CLS between the fuse sub-assembly 12 and the guide surfaces 26*a*1 and 26*b*1 (as well as 26*a*2 and 26*b*2) can be designed by a proper value so as to prevent the contact failure of the fuse sub-assembly, which may be caused by thermal expansion and/or thermal contraction of the cavity portion 16.

In addition, since it is not necessary to make the gap CLS larger than needs at the center of the housing 15 or at the intermediate fuse mounting portion 14, it is possible to make an outside dimension of the housing 15, namely an outside dimension of the electric connector box 10, at a proper value. For example, when compared with a case in which the gap CLS is made equal to one another among the fuse mounting portions, the outside dimension of the housing 15 can be made smaller in the above modification.

Figure 8B:
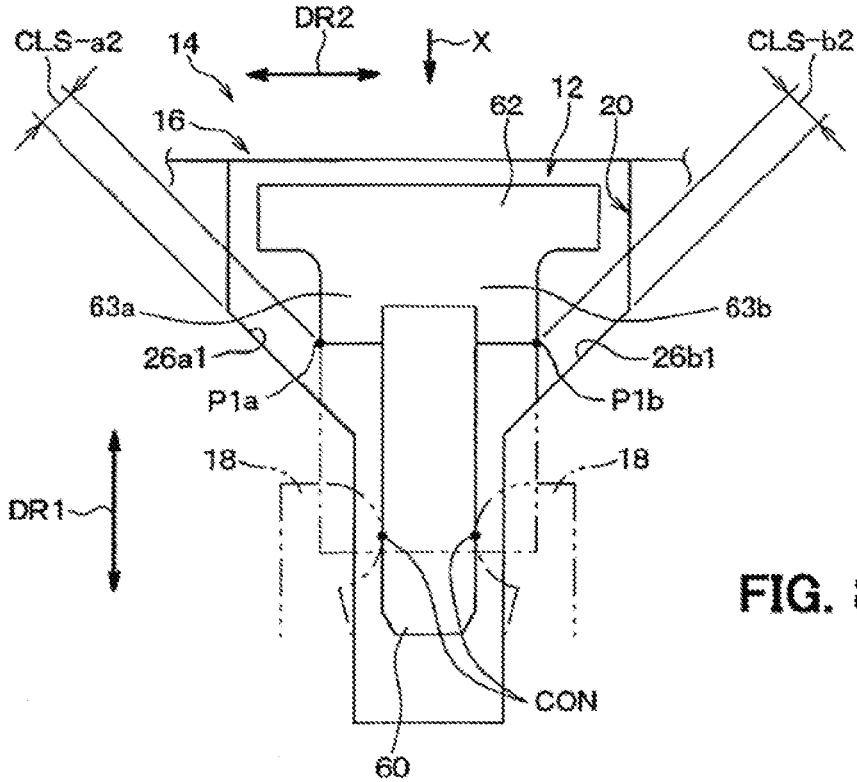
FIG. 8B is a schematic view showing the fuse sub-assembly of FIG. 6, which is mounted to the fuse mounting portion of FIG. 3, in which the gap between the between the fuse sub-assembly and the guide surfaces is smaller than a similar gap in FIG. 8A.
Figure 8C:
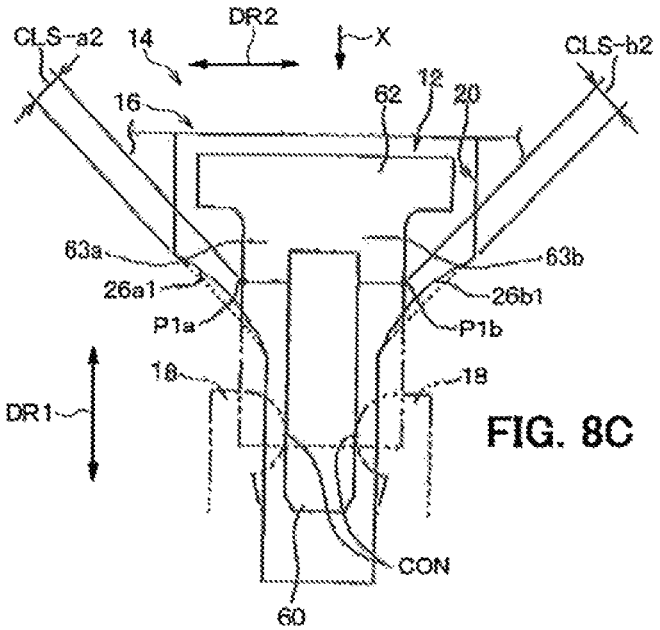
FIG. 8C is a schematic view showing the fuse sub-assembly of FIG. 6, which is mounted to the fuse mounting portion of FIG. 3, in which the guide surfaces are convex.
Figure 8D:
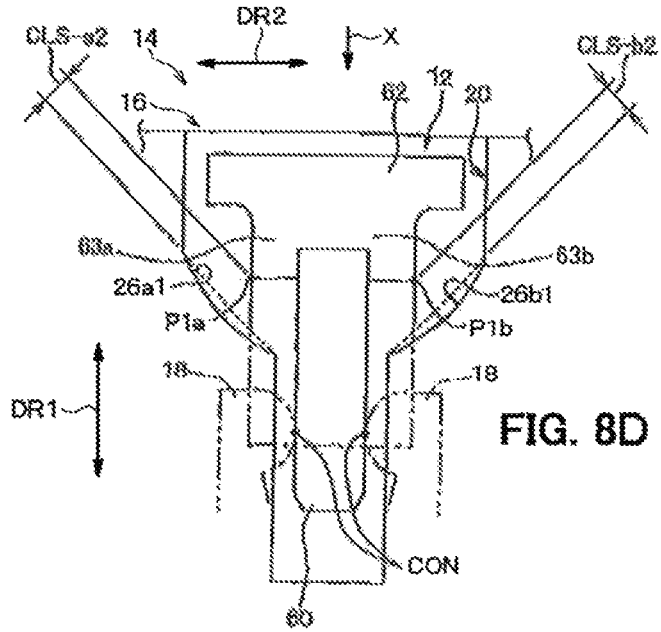
FIG. 8D is a schematic view showing the fuse sub-assembly of FIG. 6, which is mounted to the fuse mounting portion of FIG. 3, in which the guide surfaces are concave.

FIG. 8B is a schematic view showing the fuse sub-assembly of FIG. 6, which is mounted to the fuse mounting portion of FIG. 3, in which the gap between the between the fuse sub-assembly and the guide surfaces is smaller than a similar gap in FIG. 8A. Therefore, FIGS. 8A and 8B together show that the gap can be relatively larger or relatively smaller in different embodiments.

As above, the present disclosure should not be limited to the above-explained embodiment but can be modified in various manners within scopes of protection in the following claims.

What is claimed is:

1. A fuse assembly comprising:

multiple fuse mounting portions formed in a housing made of resin and arranged with one another in a width direction of the fuse mounting portion, each of the fuse mounting portions having a fuse accommodating hole: and a fuse sub-assembly having a pair of male terminals and mounted to the fuse mounting portion by inserting the fuse sub-assembly into the fuse accommodating hole in a fuse-insertion direction, wherein each of the fuse mounting portions comprises;

a cavity portion formed by the fuse accommodating hole and having an opening end formed at one end of the cavity portion in a height direction of the fuse mounting portion, the fuse sub-assembly being inserted into the cavity portion through the opening end, the cavity portion further having a bottom wall at the other end of the cavity portion opposing to the opening end in the fuse-insertion direction; and a pair of female terminals provided in the bottom wall of the cavity portion and arranged in a longitudinal direction of the cavity portion, each of the female terminals being electrically connected to the respective male terminals and holding the fuse sub-assembly in the cavity portion, wherein the cavity portion has a stopper portion at the bottom wall, so that the fuse sub-assembly is in contact with the stopper portion in the fuse-insertion direction in a fuse-mounted condition, wherein the cavity portion has a first pair of projecting portions at a longitudinal end of the cavity portion and a second pair of projecting portions at another longitudinal end of the cavity portion, each of the projecting portions is projecting into an inside of the cavity portion, and the projecting portions of the first pair and the projecting portions of the second pair are respectively arranged in the width direction of the cavity portion;

wherein a guide surface is formed at each end of the respective projecting portion in the fuse-insertion direction and on a side closer to the opening end in order to guide the male terminals toward the female terminals when the fuse sub-assembly is inserted into the cavity portion, wherein each of a distance in the width direction between the guide surfaces formed at the first pair of the projecting portions as well as a distance in the width direction between the guide surfaces formed at the second pair of the projecting portions becomes larger in the fuse-insertion direction toward the opening end of the cavity portion, wherein a gap is formed between the fuse sub-assembly and the guide surfaces in the fuse-mounted condition in which the fuse sub-assembly is inserted into the cavity portion until the fuse sub-assembly is brought into contact with the stopper portion, and wherein the gap between the fuse sub-assembly and the guide surfaces at one of the multiple fuse mounting portions becomes larger as said fuse mounting portion is more separated from an intermediate fuse mounting portion.

2. The fuse assembly of claim 1, wherein a portion of each guide surface is formed over a corresponding female terminal.

3. The fuse assembly of claim 1, wherein the guide surfaces are concave.

4. The fuse assembly of claim 1, wherein the guide surfaces are convex.

5. The fuse assembly of claim 1, wherein the male terminals are plate-type terminals.

6. The fuse assembly of claim 1, wherein the female terminals are one of press-insert type terminals, tongue-shaped terminals, or faston terminals.

7. A fuse assembly comprising:

multiple fuse mounting portions formed in a housing made of resin and arranged with one another in a width direction of the fuse mounting portion, each of the fuse mounting portions having a fuse accommodating hole: and a fuse sub-assembly having a pair of male terminals and mounted to the fuse mounting portion by inserting the fuse sub-assembly into the fuse accommodating hole in a fuse-insertion direction, wherein each of the fuse mounting portions comprises;

a cavity portion formed by the fuse accommodating hole and having an opening end formed at one end of the cavity portion in a height direction of the fuse mounting portion, the fuse sub-assembly being inserted into the cavity portion through the opening end, the cavity portion further having a bottom wall at the other end of the cavity portion opposing to the opening end in the fuse-insertion direction; and a pair of female terminals provided in the bottom wall of the cavity portion and arranged in a longitudinal direction of the cavity portion, each of the female terminals being electrically connected to the respective male terminals and holding the fuse sub-assembly in the cavity portion, wherein the cavity portion has a stopper portion at the bottom wall, so that the fuse sub-assembly is in contact with the stopper portion in the fuse-insertion direction in a fuse-mounted condition, wherein the cavity portion has a first pair of projecting portions at a longitudinal end of the cavity portion and a second pair of projecting portions at another longitudinal end of the cavity portion, each of the projecting portions is projecting into an inside of the cavity portion, and the projecting portions of the first pair and the projecting portions of the second pair are respectively arranged in the width direction of the cavity portion;

wherein a guide surface is formed at each end of the respective projecting portion in the fuse-insertion direction and on a side closer to the opening end in order to guide the male terminals toward the female terminals when the fuse sub-assembly is inserted into the cavity portion, wherein each of a distance in the width direction between the guide surfaces formed at the first pair of the projecting portions as well as a distance in the width direction between the guide surfaces formed at the second pair of the projecting portions becomes larger in the fuse-insertion direction toward the opening end of the cavity portion, wherein a gap is formed between the fuse sub-assembly and the guide surfaces in the fuse-mounted condition in which the fuse sub-assembly is inserted into the cavity portion such that the fuse sub-assembly is brought into contact with the stopper portion, and wherein the gap between the fuse sub-assembly and the guide surfaces is smaller for a first one of the multiple fuse mounting portions located at an intermediate position of the multiple fuse mounting portions than for a second one of the multiple fuse mounting portions located at a peripheral position of the multiple fuse mounting portions.

8. The fuse assembly of claim 7, wherein a portion of each guide surface is formed over a corresponding female terminal.

9. The fuse assembly of claim 7, wherein the guide surfaces are concave.

10. The fuse assembly of claim 7, wherein the guide surfaces are convex.

11. The fuse assembly of claim 7, wherein the male terminals are plate-type terminals.

12. The fuse assembly of claim 7, wherein the female terminals are one of press-insert type terminals, tongue-shaped terminals, or faston terminals.

* * * * *